US009982689B2

(12) United States Patent
Feulner

(10) Patent No.: US 9,982,689 B2
(45) Date of Patent: May 29, 2018

(54) APPARATUS AND METHOD FOR WATER AND ICE FLOW MANAGEMENT IN A GAS TURBINE ENGINE

(71) Applicant: United Technologies Corporation, Farmington, CT (US)

(72) Inventor: Matthew R. Feulner, West Hartford, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 334 days.

(21) Appl. No.: 14/826,492

(22) Filed: Aug. 14, 2015

(65) Prior Publication Data

US 2017/0045061 A1 Feb. 16, 2017

(51) Int. Cl.

| | |
|---|---|
| ***F04D 29/70*** | (2006.01) |
| ***F04D 29/32*** | (2006.01) |
| ***F04D 29/54*** | (2006.01) |
| ***F01D 25/32*** | (2006.01) |

(52) U.S. Cl.

CPC ..... *F04D 29/706* (2013.01); *F01D 25/32* (2013.01); *F04D 29/321* (2013.01); *F04D 29/542* (2013.01); *F05D 2240/123* (2013.01); *F05D 2260/602* (2013.01)

(58) Field of Classification Search

CPC .... F04D 29/706; F04D 29/542; F04D 29/321; F01D 25/32; F05D 2260/602

See application file for complete search history.

(56) References Cited

U.S. PATENT DOCUMENTS 5,339,622 A 8/1994 Bardey et al.

FOREIGN PATENT DOCUMENTS

| | | |
|---|---|---|
| EP | 3009602 A1 | 4/2016 |
| WO | 2015015858 A1 | 2/2015 |

OTHER PUBLICATIONS

Machine translation of WO 2015/015858 A1, Takata, May 2, 2015.*
European Search Report for Application No. 16184229.

* cited by examiner

*Primary Examiner* — Woody Lee, Jr.
*Assistant Examiner* — Maxime Adjagbe
(74) *Attorney, Agent, or Firm* — Cantor Colburn LLP

(57) ABSTRACT

A compressor of a gas turbine engine includes at least one rotor, and at least one stator, wherein the at least one stator includes a water channel wall located on a surface of the stator, wherein the water channel wall is configured to direct water away from a center line of the turbine engine and is located an offset distance from an outside wall of the compressor, wherein the offset distance is zero percent to twenty percent of the span of the stator.

16 Claims, 2 Drawing Sheets

APPARATUS AND METHOD FOR WATER AND ICE FLOW MANAGEMENT IN A GAS TURBINE ENGINE

BACKGROUND

The subject matter disclosed herein relates to turbine engines, and more particularly, to a system and a method for water flow management in a turbine engine.

Typically, turbine engines, such as turbine engines of an aircraft, are subjected to a wide variety of environmental conditions, including atmospheric rain, hail, or ice crystals. Often, the introduction of water and ice into a turbine engine is undesirable for operation of the compressor and combustor portion of the turbine engine.

Accordingly, it is desirable to extract water, ice or other particulate matter from a turbine engine or divert it away from an undesirable location within the turbine engine.

BRIEF SUMMARY

According to one embodiment, a stator of a compressor of a turbine engine includes a water channel wall located on a surface of the stator, wherein the water channel wall is configured to direct water away from a center line of the turbine engine and is located an offset distance from an outside wall of the compressor, wherein the offset distance is zero percent to twenty percent of a span of the stator.

In addition to one or more of the features described above, or as an alternative, further embodiments could include that the water channel wall is integrally formed with the stator.

In addition to one or more of the features described above, or as an alternative, further embodiments could include that the stator is disposed upstream of a bleed port of the turbine engine.

In addition to one or more of the features described above, or as an alternative, further embodiments could include that the stator is disposed upstream of a combustor of the turbine engine.

In addition to one or more of the features described above, or as an alternative, further embodiments could include that the stator is an exit guide vane.

In addition to one or more of the features described above, or as an alternative, further embodiments could include that the water channel wall is disposed on a pressure side of the stator.

In addition to one or more of the features described above, or as an alternative, further embodiments could include that the water channel wall includes an outer edge angled towards the outside wall.

In addition to one or more of the features described above, or as an alternative, further embodiments could include that the water channel wall includes an inner edge angled towards the outside wall.

According to one embodiment, a method to extract water within a compressor of a turbine engine includes introducing an airflow to the turbine engine, directing the airflow towards a surface of a stator of the turbine engine, and capturing a water content of the airflow via a water channel wall located on a surface of the stator of the turbine engine, wherein the water channel wall is located an offset distance from an outside wall of the compressor, wherein the offset distance is zero percent to twenty percent of a span of the stator.

In addition to one or more of the features described above, or as an alternative, further embodiments could include receiving the water content within the airflow via the water channel wall from a preceding rotor.

In addition to one or more of the features described above, or as an alternative, further embodiments could include directing the captured water content away from a center line of the turbine engine via the water channel wall.

In addition to one or more of the features described above, or as an alternative, further embodiments could include directing the captured water content within the airflow to the outside wall of the compressor via the water channel wall.

In addition to one or more of the features described above, or as an alternative, further embodiments could include that the water channel wall is integrally formed with the stator.

In addition to one or more of the features described above, or as an alternative, further embodiments could include that the stator is disposed upstream of a bleed port of the turbine engine.

In addition to one or more of the features described above, or as an alternative, further embodiments could include that the stator is disposed upstream of a combustor of the turbine engine.

In addition to one or more of the features described above, or as an alternative, further embodiments could include that the stator is an exit guide vane.

In addition to one or more of the features described above, or as an alternative, further embodiments could include that the water channel wall is disposed on a pressure side of the stator.

In addition to one or more of the features described above, or as an alternative, further embodiments could include that the water channel includes an outer edge angled towards the outside wall.

In addition to one or more of the features described above, or as an alternative, further embodiments could include that the water channel includes an inner edge angled toward the outside wall.

According to one embodiment, a compressor of a gas turbine engine includes at least one rotor, and at least one stator, wherein the at least one stator includes a water channel wall located on a surface of the stator, wherein the water channel wall is configured to direct water away from a center line of the turbine engine and is located an offset distance from an outside wall of the compressor, wherein the offset distance is zero percent to twenty percent of the span of the stator.

Other aspects, features, and techniques of the embodiments will become more apparent from the following description taken in conjunction with the drawings.

BRIEF DESCRIPTION OF THE DRAWINGS

The subject matter which is regarded as the present disclosure is particularly pointed out and distinctly claimed in the claims at the conclusion of the specification. The foregoing and other features, and advantages of the present disclosure are apparent from the following detailed description taken in conjunction with the accompanying drawings in which:

DETAILED DESCRIPTION

Figure 1:
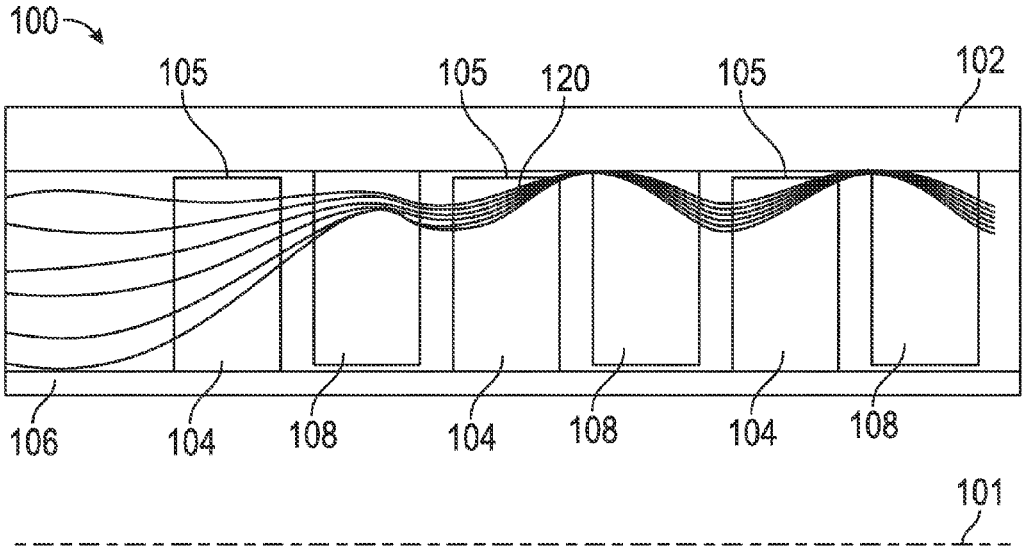
FIG. 1 is a schematic cross sectional view of a prior art set of compressor stages within a turbine engine.

Referring now to the drawings, FIG. 1 illustrates a set of compressor stages 100 within a gas turbine or turbine engine. In the illustrated embodiment, the compressor stages 100 include among other elements, an outside wall 102, a rotor 104, and a stator 108.

The compressor stages 100 may be used with any suitable turbine engine, including, but not limited to a gas turbine engine for use in an aircraft. During operation, the compressor stages 100 introduces airflow through rotors 104 and stators 108. During operation and in certain environments, water and/or ice may be introduced along with the aforementioned airflow of the compressor stages 100.

The compressor stages 100 may include among other components rotors 104 and stators 108. The rotors 104 are configured to rotate about a centerline 101 along the longitudinal axis of the compressor stages 100 and are connected to a hub 106. During operation of the engine, the rotors 104 introduce and compress airflow as the hub 106 rotates. The rotation of the rotors 104 about the longitudinal axis may force water toward the outside wall 102.

In FIG. 1 a set of rotors 104 and stators 108 of the compressor stages 100 is shown. In some embodiments, the stator 108 is the last stator of the compressor, wherein the stator 108 serves as an exit guide vane before a combustor of the engine. The stator 108 receives the airflow after it has passed through the rotor 104. As illustrated by the path 120 depicting a water flow, water exits the rotor 104 along the outside wall 102 and impinges upon the pressure side of the stator 108. Typically and without a water channel of the present disclosure and as described herein, the water may migrate towards the center line 101 of the compressor stages 100, which is undesirable.

Figure 2:
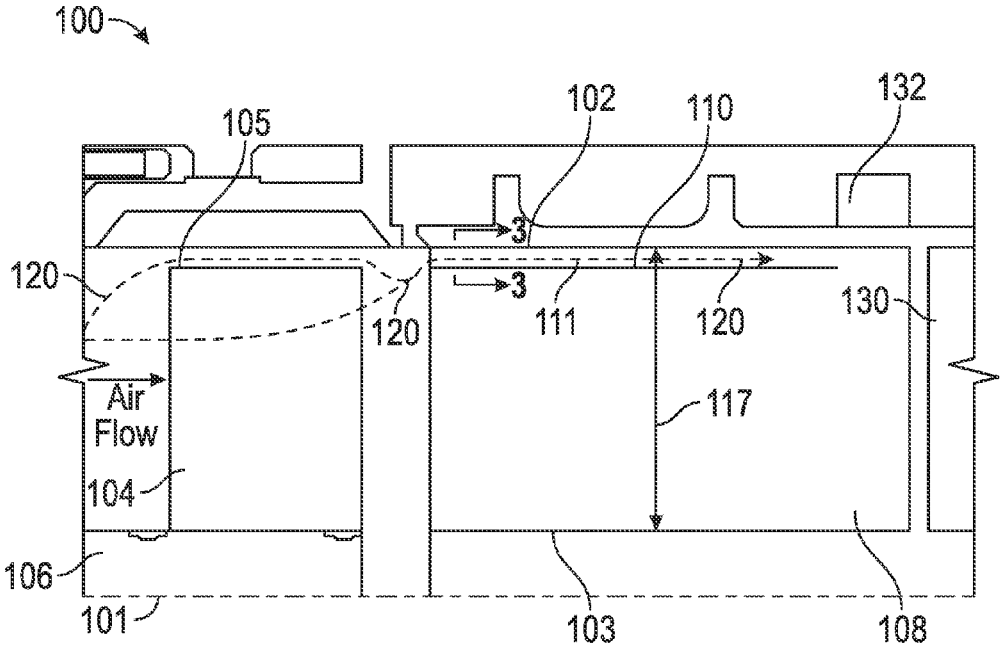
FIG. 2 is a schematic cross sectional view of a compressor stage within a turbine engine in accordance with an embodiment of the disclosure.
Figure 3:
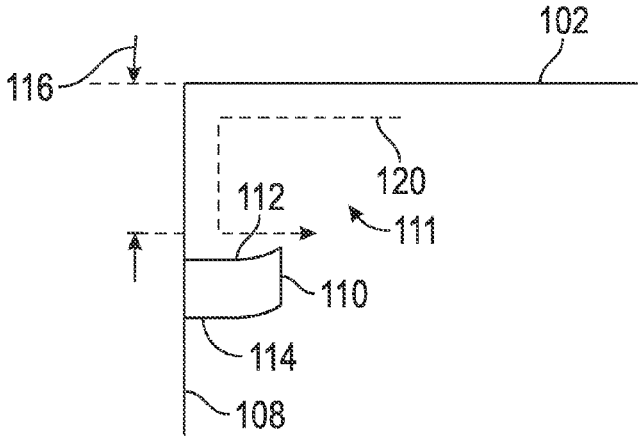
FIG. 3 is a cross-sectional view along lines 3-3 of FIG. 2.

Referring now FIGS. 2 and 3, a compressor stage 100 of a gas turbine or turbine engine with a water channel wall 110 is illustrated. In the illustrated embodiment, the compressor stage 100 includes among other elements, an outside wall 102, a rotor 104, a stator 108, and a water channel wall 110.

In FIGS. 2 and 3 a pressure side of a stator 108 of the compressor stage 100 is shown. In some embodiments, the stator 108 is the last stator of the compressor stage, wherein the stator 108 serves as an exit guide vane before a combustor of the engine. The stator 108 receives the airflow after it has passed through the rotor 104. As illustrated by the arrows 120 depicting a water flow, water exits the rotor along the outside wall 102 and impinges upon the pressure side of the stator 108. Accordingly, the water flow can be received by the water channel 111 formed by water channel wall 110 and the outside wall 102.

As illustrated, water channel wall 110 is located on a surface of the stator 108. In some embodiments, the water channel wall 110 may be integrally formed with the stator 108. As best shown in FIG. 2, the water channel wall 110 may extend along at least a partial chord length, along the direction of airflow, of the stator 108.

The water channel wall 110 is configured to capture water by utilizing the viscosity and inertia of the water within the airflow to direct the water into the water channel 111 toward the outside wall 102 of the compressor stage 100, as shown by arrows 120 in FIGS. 2 and 3. In some embodiments, the geometry of the water channel wall 110 further receives water that has been forced towards the outside wall by the rotation of the rotor 104 about its axis. The inner edge 114 of the water channel wall 110 is generally angled toward the outside wall 102 to minimize airflow disturbance, while the outer edge 112 of the water channel wall 110 is generally angled toward the outside wall 102 to direct and retain the water flow, as depicted by the arrows 120, towards the outside wall 102.

In one embodiment, the water channel wall 110 may be offset an offset distance 116 from the outside wall 102. The offset distance 116 can be any suitable distance from the outside wall 102. In one non-limiting embodiment, the offset distance 116 is 20% of the span 117 of the stator 108 containing the water channel wall 110, wherein the span 117 is the distance from the inside wall 103 of the stator 108 to the outside wall 102 of the stator 108. In other embodiments, the offset distance 116 is approximately or less than 20% of the span 117 of the stator 108 containing the water channel wall 110.

Advantageously, the geometry of the water channel wall 110 allows for passive redirection of the water flow, as depicted by arrows 120, by taking advantage of the coalescing nature of the water within the compressor stage 100 after the water passes beyond the rotor 104 and is forced outward towards the outside wall 102 by the centrifugal action of the rotor 104. Further, the geometry of the water channel wall 110 prevents the dissipation of the water as it impinges on the stator 108, as depicted in FIG. 1. Referring back to FIGS. 2 and 3, the water channel wall 110 is configured to keep the water flow, as depicted by arrows 120, concentrated towards the outside wall 102.

The stator 108 is disposed before downstream components such as a combustor 130. In certain embodiments, the stator 108 is disposed before a bleed orifice 132. Accordingly, water channel wall 110 may increase the water content in the airflow that is directed to the bleed orifice 132 to remove it from the primary flow path. In other embodiments, the stator 108 is disposed before the combustor 130 of the turbine engine, wherein the stator 108 is an exit guide vane. In this embodiment, the water channel wall 110 may prevent moisture from entering the combustor 130 by diverting water away from the primary combustion zone of the combustor 130.

Figure 4:
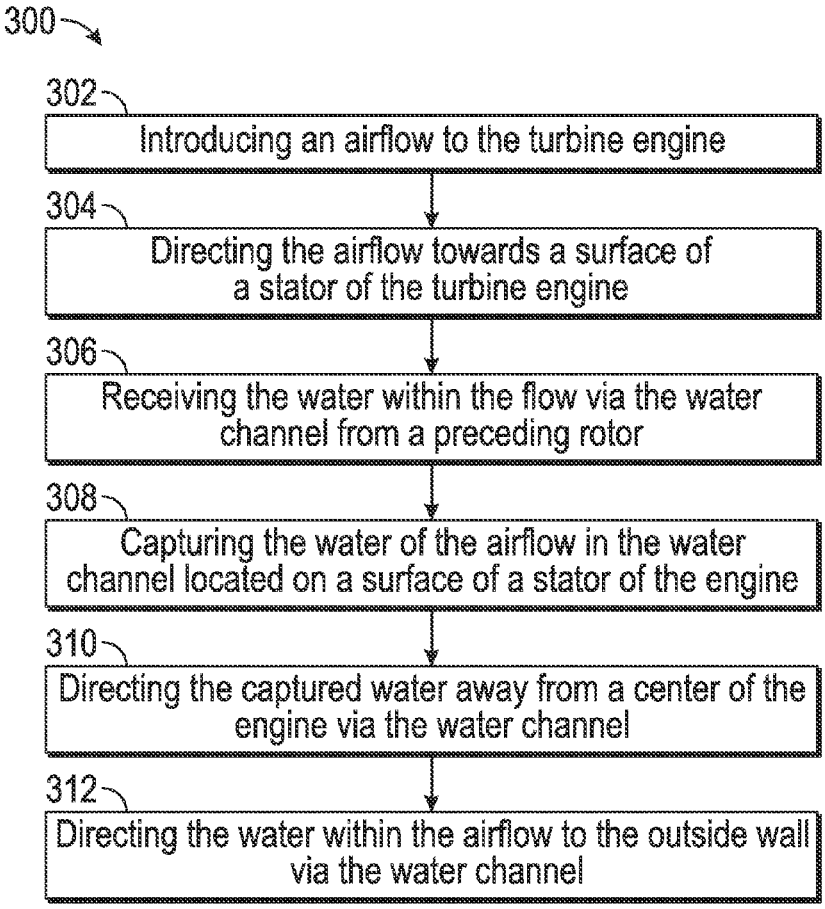
FIG. 4 is a flow chart depicting a method of extracting water and ice from a turbine engine in accordance with an embodiment of the disclosure.

Referring now to FIG. 4, a method for extracting water from a compressor stage of a turbine engine is illustrated by a flow chart 300. As mentioned above, a water channel wall is located on a stator of the turbine engine, wherein the water channel wall is an offset distance from an outside wall of the turbine engine. In some embodiments, the water channel may extend along at least a partial length of the stator in the direction of airflow. In one non-limiting embodiment, the water channel wall is offset an offset distance from the outside wall. In one non-limiting embodiment, the offset distance is approximately 20% of the span of the stator containing the water channel. In other embodiments, the offset distance is less than 20% of the span of the stator.

As mentioned above, the stator may be disposed upstream of a bleed port of the turbine engine. Advantageously, the use of the water channel can increase the water content of airflow that is directed to the bleed orifice. Alternatively, the stator may be disposed upstream of a combustor of the turbine engine. Advantageously, the water channel can prevent moisture from entering the combustor to prevent combustor blow outs by diverting water away from the primary combustion zone of the combustor.

During operation of the turbine engine, airflow is introduced to the turbine engine. This is illustrated by box or step 302. During operation, the rotors introduce and compress airflow as the hub rotates.

Thereafter, the airflow within the compressor stage is directed to a surface of a stator of the turbine engine. This is illustrated by box or step 304. At this step, the airflow is turned by the stator to facilitate compression within the compressor section of the turbine engine.

Water within the airflow directed to the pressure side of the stator is received within the water channel wall from a preceding rotor. This is illustrated by box or step 306. As mentioned above, the rotation of the rotors may force water into the water channel toward the outside wall and is then received by the water channel wall.

Water received from the airflow is captured in the water channel located on a surface of the stator of the engine. This is illustrated by box or step 308. At this step, water resident in the airflow of the compressor stage is similarly impinged upon the pressure side of the stators of the engine, and the impinged water is captured by the water channel on a surface of a stator of the engine.

Thereafter, the captured water is directed away from a center of the engine within the water channel. This is illustrated by box or step 310. Accordingly, the water channel provides an operational barrier to prevent the migration of water towards the center of the engine. Depending on the location of the water channel, water can be directed away from the primary combustion zone of a combustor, or toward a bleed orifice, etc.

Further, the water within the flow is directed in the water channel towards the outside wall via the water channel wall. This is illustrated by box or step 312. As described above, the inner edge of the water channel wall has a generally angled toward the outside wall to minimize airflow disturbance, while the outer edge of the water channel is angled toward the outside wall to direct the water flow towards the outside wall.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A stator of a compressor of a turbine engine, the stator having a water channel wall located on a surface of the stator, wherein the water channel wall is configured to direct water away from a center line of the turbine engine and is located an offset distance from an outside wall of the compressor, wherein the offset distance is zero percent to twenty percent of a span of the stator, wherein the water channel wall includes an outer edge and an inner edge angled towards the outside wall.

2. The stator of claim 1, wherein the water channel wall is integrally formed with the stator.

3. The stator of claim 1, wherein the stator is disposed upstream of a bleed port of the turbine engine.

4. The stator of claim 1, wherein the stator is disposed upstream of a combustor of the turbine engine.

5. The stator of claim 4, wherein the stator is an exit guide vane.

6. The stator of claim 1, wherein the water channel wall is disposed on a pressure side of the stator.

7. A method to extract water within a compressor of a turbine engine, the method comprising:

introducing an airflow to the turbine engine;

directing the airflow towards a surface of a stator of the turbine engine; and capturing a water content of the airflow via a water channel wall located on a surface of the stator of the turbine engine, wherein the water channel wall is located an offset distance from an outside wall of the compressor, wherein the offset distance is zero percent to twenty percent of a span of the stator, wherein the water channel wall includes an outer edge and an inner edge angled towards the outside wall.

8. The method of claim 7, further comprising:

receiving the water content within the airflow via the water channel wall from a preceding rotor.

9. The method of claim 7, further comprising:

directing the captured water content away from a center line of the turbine engine via the water channel wall.

10. The method of claim 7, further comprising:

directing the captured water content within the airflow to the outside wall of the compressor via the water channel wall.

11. The method of claim 7, wherein the water channel wall is integrally formed with the stator.

12. The method of claim 7, wherein the stator is disposed upstream of a bleed port of the turbine engine.

13. The method of claim 7, wherein the stator is disposed upstream of a combustor of the turbine engine.

14. The method of claim 13, wherein the stator is an exit guide vane.

15. The method of claim 7, wherein the water channel wall is disposed on a pressure side of the stator.

16. A compressor of a gas turbine engine, comprising:

at least one rotor; and at least one stator, wherein the at least one stator includes a water channel wall located on a surface of the stator, wherein the water channel wall is configured to direct water away from a center line of the turbine engine and is located an offset distance from an outside wall of the compressor, wherein the offset distance is zero percent to twenty percent of the span of the stator, wherein the water channel wall includes an outer edge and an inner edge angled towards the outside wall.

* * * * *